US010280932B2

(12) United States Patent
Mei et al.

(10) Patent No.: US 10,280,932 B2
(45) Date of Patent: May 7, 2019

(54) SEALING CLEARANCE CONTROL IN TURBOMACHINES

(71) Applicant: Nuovo Pignone Srl, Florence (IT)

(72) Inventors: Luciano Mei, Florence (IT); Massimiliano Borghetti, Florence (IT); Massimo Pinzauti, Florence (IT); Manuele Bigi, Florence (IT); Luca Innocenti, Florence (IT); Alberto Ceccherini, Florence (IT); Marco Formichini, Florence (IT); Rajesh Mavuri, Bangalore (IN)

(73) Assignee: Nuovo Pignone SRL, Florence (IT)

( * ) Notice: Subject to any disclaimer, the term of this patent is extended or adjusted under 35 U.S.C. 154(b) by 395 days.

(21) Appl. No.: 15/029,297

(22) PCT Filed: Oct. 10, 2014

(86) PCT No.: PCT/EP2014/071795
§ 371 (c)(1),
(2) Date: Apr. 14, 2016

(87) PCT Pub. No.: WO2015/055542
PCT Pub. Date: Apr. 23, 2015

(65) Prior Publication Data

US 2016/0238015 A1 Aug. 18, 2016

(30) Foreign Application Priority Data

Oct. 14, 2013 (IT) ..... FI2013A0237

(51) Int. Cl.
*F04D 29/16* (2006.01)
*F04D 29/58* (2006.01)
(Continued)

(52) U.S. Cl.
CPC ..... *F04D 29/162* (2013.01); *F01D 11/04* (2013.01); *F01D 11/06* (2013.01); *F04D 17/12* (2013.01); *F04D 29/584* (2013.01)

(58) Field of Classification Search
CPC ..... F01D 11/06; F01D 11/08; F01D 11/04; F04D 29/162; F04D 29/584
See application file for complete search history.

(56) References Cited

U.S. PATENT DOCUMENTS 3,966,351 A 6/1976 Sproule
4,679,981 A * 7/1987 Guibert ..... F01D 11/08 415/116

(Continued)

FOREIGN PATENT DOCUMENTS

CN 1854468 A 11/2006
EP 0408010 A1 1/1991

(Continued)

OTHER PUBLICATIONS

Italian Search Report and Written Opinion issued in connection with corresponding Italian Application No. ITFI20130237 dated Mar. 3, 2014.

(Continued)

*Primary Examiner* — Richard A Edgar
*Assistant Examiner* — Michael L Sehn
(74) *Attorney, Agent, or Firm* — GE Global Patent Operation; Robert D. Crawford II

(57) ABSTRACT

The turbomachine comprises a stationary component, a rotary component, rotatingly supported in the stationary component, and a sealing arrangement between the rotary component and the stationary component. A cooling arrangement is further provided, which is configured and designed for delivering a cooling fluid to the sealing arrangement and removing heat therefrom.

20 Claims, 4 Drawing Sheets

(51) Int. Cl.

| | |
|---|---|
| ***F01D 11/04*** | (2006.01) |
| ***F01D 11/06*** | (2006.01) |
| ***F04D 17/12*** | (2006.01) |

(56) References Cited

U.S. PATENT DOCUMENTS

| | | | | |
|---|---|---|---|---|
| 5,297,928 | A * | 3/1994 | Imakiire | F04D 29/5846 415/112 |
| 6,126,390 | A | 10/2000 | Bock | |
| 6,190,123 | B1 | 2/2001 | Wunderwald et al. | |
| 6,276,896 | B1 | 8/2001 | Burge et al. | |
| 7,937,951 | B2 | 5/2011 | Brunet et al. | |
| 8,029,238 | B2 | 10/2011 | Argaud et al. | |
| 2011/0171005 | A1 * | 7/2011 | Ito | F01D 5/081 415/115 |

FOREIGN PATENT DOCUMENTS

| | | | |
|---|---|---|---|
| EP | 518027 | A1 | 12/1992 |
| JP | S63-182368 | U | 11/1988 |
| JP | H02-130296 | A | 5/1990 |
| JP | H04-365997 | A | 12/1992 |
| JP | 2003-525377 | A | 8/2003 |
| JP | 2006-307853 | A | 11/2006 |
| JP | 2010-038114 | A | 2/2010 |
| RU | 2478799 | C2 | 4/2013 |
| RU | 2496991 | C1 | 10/2013 |
| WO | 01/29426 | A1 | 4/2001 |
| WO | 129426 | A1 | 4/2001 |
| WO | 1294266 | A1 | 4/2001 |

OTHER PUBLICATIONS

International Search Report and Written Opinion issued in connection with corresponding Application No. PCT/EP2014/071795 dated Jan. 14, 2015.

Camatti, M., et al., Centrifugal Compressor Impeller Cooling, GE Co-Pending Application No. FI2012A000124, filed on Jun. 19, 2012.

International Preliminary Report on Patentability issued in connection with corresponding PCT Application No. PCT/EP2014/071795 dated Apr. 19, 2016.

Machine Translation and First Office Action and Search issued in connection with corresponding CN Application No. 201480056561.1 dated Nov. 18, 2016.

Machine Translation and Second Office Action and Search issued in connection with corresponding CN Application No. 201480056561.1 dated Aug. 7, 2017.

Office Action and Search Report issued in connection with corresponding RU Application No. 2016112982 dated Jul. 13, 2018.

Machine Translation and Notification of Reasons for Refusal issued in connection with corresponding JP Application No. 2016-521967 dated Aug. 14, 2018.

* cited by examiner

SEALING CLEARANCE CONTROL IN TURBOMACHINES

BACKGROUND

The subject matter disclosed herein relates to turbomachines. More specifically, the present disclosure concerns improvements in sealing arrangements for turbomachines working at high temperatures.

Turbomachines, such as centrifugal compressors, turbines, and the like, are often operated at high temperature, and both the rotor components as well as the stator components thereof are subject to thermal expansions.

In fast start-up machines, i.e. machines where the start-up procedure is performed in a short period of time, the seal clearance between a sealing arrangement, mounted on a stationary component, and a rotary component must be designed so that during start-up the sealing arrangement does not contact the rotary component, which is subject to a fast dimensional increase due to centrifugal and thermal radial growth in radial direction.

In order to prevent sealing damages during start-up, due to the stator radial growth being slower than the rotor radial growth, the diameter dimension of the sealing arrangement is designed so that a sufficient radial clearance is maintained also at start-up. Consequently, the radial sealing clearance, when the steady state operating condition of the turbomachine is achieved, is comparatively large. A large radial clearance causes a drop of efficiency of the turbomachine.

There is therefore a need for an improved control over the radial clearance of sealing arrangements in turbomachines working at high temperature and having a fast start-up procedure.

SUMMARY OF THE INVENTION

According to one aspect, the subject matter disclosed herein provides a turbomachine, comprising: a stationary component, a rotary component, rotatingly supported in the stationary component, and a sealing arrangement between the rotary component and the stationary component. More particularly, a cooling arrangement is further provided, configured and designed for delivering a cooling fluid to the sealing arrangement and removing heat therefrom.

By removing heat from the sealing arrangement, the sealing clearance can be controlled, in particular at steady state operating conditions, thus improving the overall efficiency of the turbomachine.

The sealing arrangement can comprise a stationary sealing ring, i.e. a sealing ring mounted in a non-rotating manner on a stationary component of the turbomachine, e.g. a diaphragm of a compressor stage.

According to some a embodiments, the cooling arrangement comprises a cooling chamber arranged at the sealing arrangement and provided with at least one cooling fluid-delivery duct, which is fluidly connected with the cooling chamber, for delivering cooling fluid therein. In some embodiments, the cooling arrangement further comprises at least one cooling fluid-discharge duct in fluid communication with the cooling chamber, for removing cooling fluid therefrom. The cooling chamber can be arranged between a sealing ring or annular sealing member of the sealing arrangement and the stationary component, whereon the sealing arrangement is mounted.

In some embodiments, the cooling chamber can be provided inside a sealing ring, or annular sealing member of the sealing arrangement, e.g. if the sealing ring has a sufficiently large cross-section.

In an embodiment, the cooling chamber is co-extensive or substantially co-extensive with the sealing member and in fluid contact therewith substantially along the entire development of the sealing member. In an embodiment, substantially co-extensive means that the circumferential extension of the cooling chamber is at least 70%, or at least 80%, even more particularly at least 90% the circumferential extension of the sealing member. The substantial co-extension of the sealing member and cooling chamber provides particularly efficient temperature control over the sealing arrangement.

The annular sealing member can be mounted on a seat of the stationary component, so that the annular sealing member and the seat are capable of mutual radial displacements. Radial expansion of the annular sealing member can thus be controlled by the cooling fluid and reduced or maintained smaller than the radial expansion of the stationary component, whereon the annular sealing member is arranged.

The exhausted cooling fluid can be re-circulated in a cooling circuit. In other embodiments, the exhausted cooling fluid can be discharged in the environment, if the nature of the cooling fluid so permits, e.g. if air is used. In some further embodiments, the cooling fluid can be the same gas processed by the turbomachine, or a gas compatible therewith. In this case, the exhausted cooling fluid can be discharged in the main flow of process gas flowing through the turbomachine, provided the pressure of the cooling gas is higher than the pressure of the process gas.

According to a further aspect, the subject matter disclosed herein concerns a method for controlling a seal clearance in a turbomachine between a rotary component of the turbomachine and a stationary sealing arrangement co-acting with the rotary component. The method comprises a step of removing heat from the sealing arrangement to reduce thermal expansion of the sealing arrangement during operation of the turbomachine.

In some embodiments, the method comprises the steps of: arranging a cooling chamber between the sealing arrangement and a stationary component, whereon the sealing arrangement is mounted; delivering a cooling fluid in the cooling chamber and removing heat from the sealing arrangement thereby.

The sealing arrangement according to the subject matter disclosed herein can be embodied in any turbomachine, where control over the sealing clearance by means of heat removal can be beneficial. Hot turbomachines, such as gas turbines, can take advantage of the arrangement described herein. Also compressors, such as axial and centrifugal compressors can be provided with a sealing arrangement as disclosed herein. This is particularly useful in case of compressors where the processed fluid reaches relatively high temperatures, such as compressors for CAES systems (Compressed Air Energy Storage systems) or ACAES systems (Adiabatic Compressed Air Energy Storage systems).

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

In the following description and in the enclosed drawings reference is made to a centrifugal multistage compressor, for example a compressor for use in so-called CAES (Compressed Air Energy Storage Systems) applications. Those skilled in the art will however appreciate that the subject matter disclosed herein can be embodied in other turbomachines where similar technical issues arise.

Figure 1:
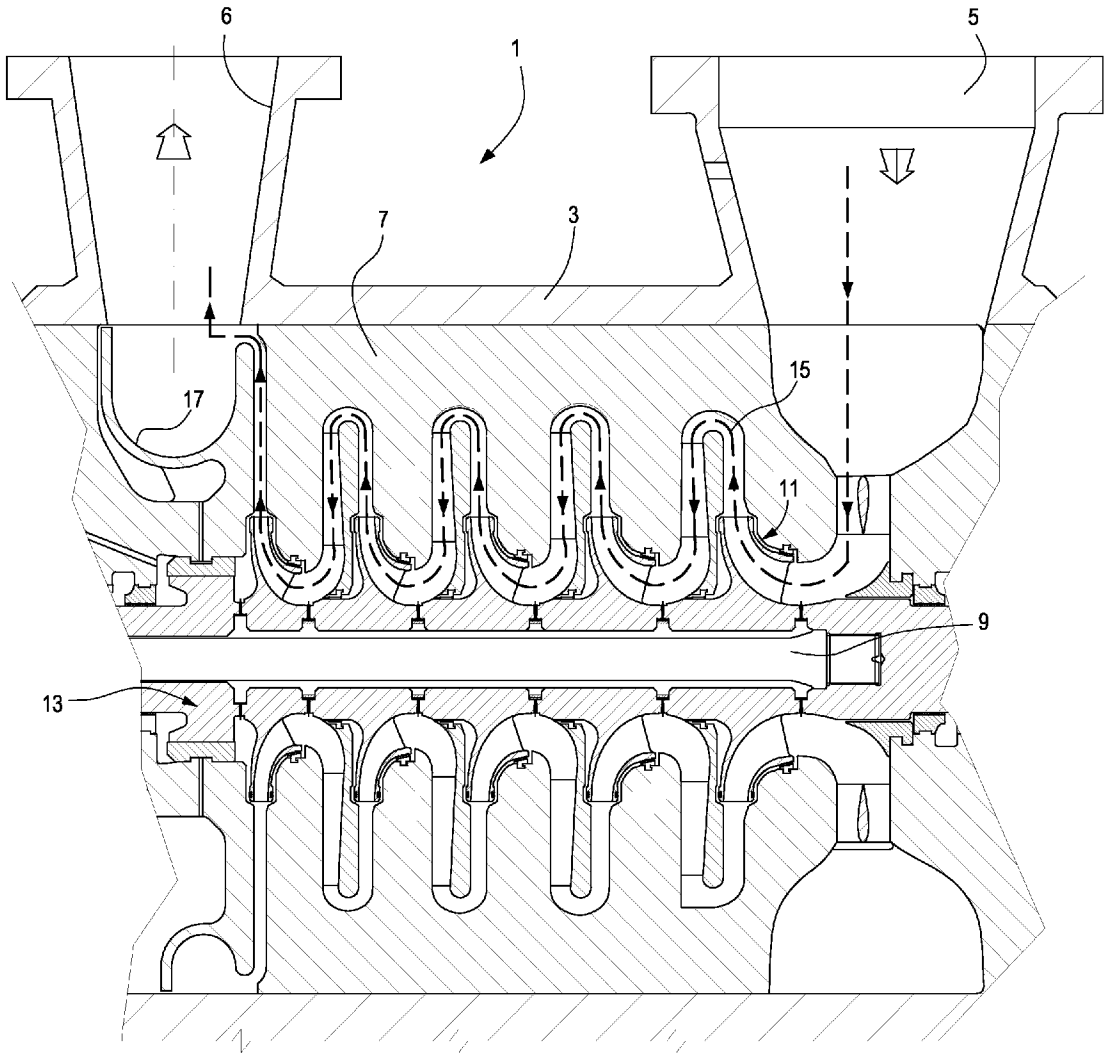
FIG. 1 illustrates a schematic sectional view of a multistage centrifugal compressor.

Referring to FIG. 1, a multistage centrifugal compressor 1 is comprised of a casing 3 having a compressor inlet 5 and a compressor outlet 6. Inside the compressor casing 3, a compressor diaphragm arrangement 7 is provided. The casing 3 and the diaphragm 7 form the stationary part of the compressor.

In the casing 3 a rotating shaft 9 is suitably supported. A plurality of impellers 11 are mounted on the shaft 9 and rotate therewith, under the control of a prime mover (not shown), for example an electric motor, a turbine or the like.

In some embodiments, a balancing drum 13 is further mounted on the shaft 9 for rotation therewith.

Return channels 15 formed in the diaphragm 7 are provide for returning the gas flow exiting each impeller 11 to the inlet of the subsequent impeller. The most downstream impeller (shown also in FIG. 2) is in fluid communication with a volute 17, which collects the compressed gas and wherefrom the compressed gas is delivered to the compressor outlet 6.

Figure 2:
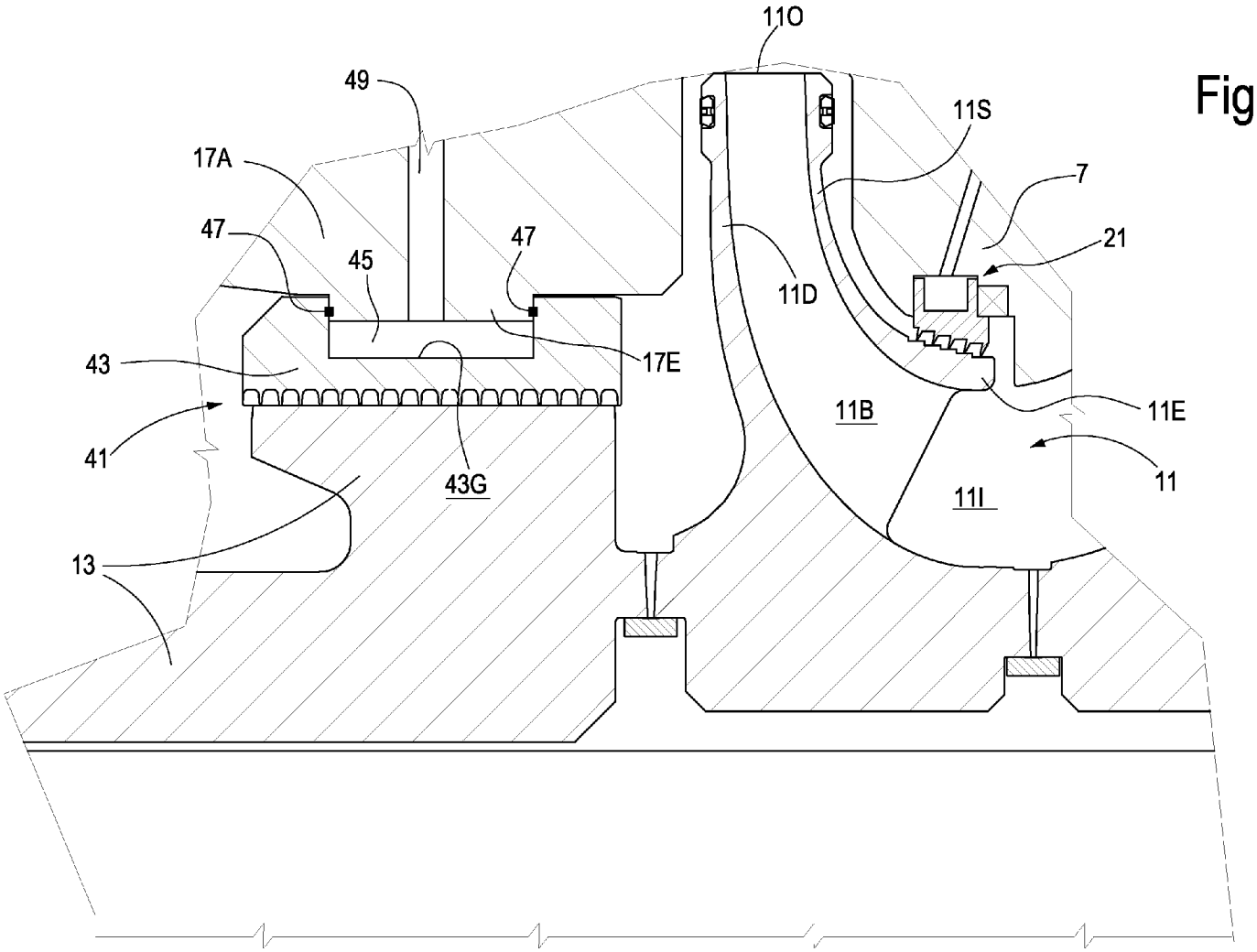
FIG. 2 illustrates an enlargement of the last stage of the compressor of FIG. 1.

As best shown in the enlargement of FIG. 2, at least some of the impellers 11 can comprise an impeller disk 11D and an impeller shroud 11S, comprised of an impeller eye 11E. Blades 11B are arranged between the impeller disk 11D and the impeller shroud 11S and define vanes inside the impeller 11, through which gas entering the impeller at an impeller inlet 111 is accelerated and finally discharged at an impeller outlet 110.

Figure 4:
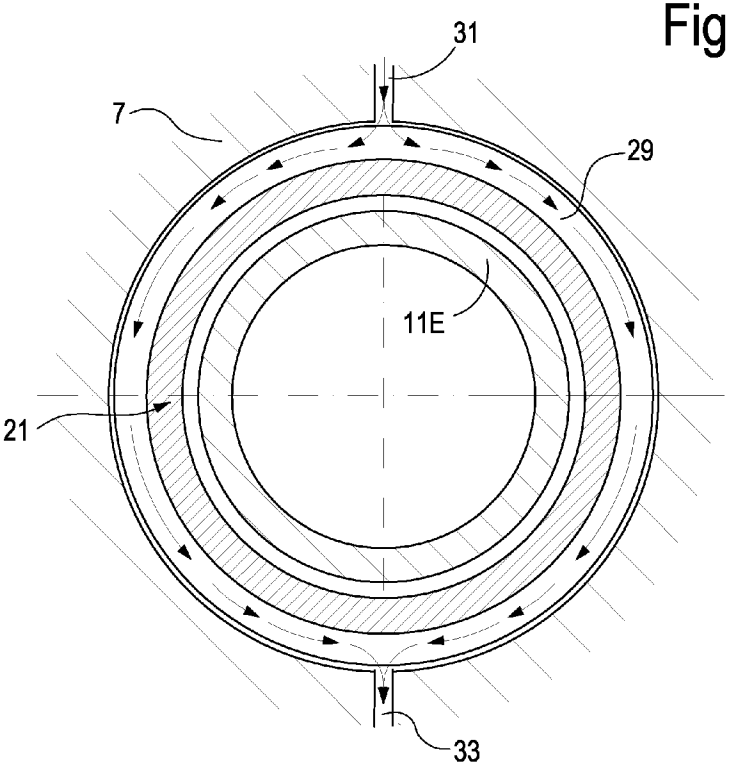
FIG. 4 illustrates a schematic cross-section according to line IV-IV in FIG. 2.
Figure 3:
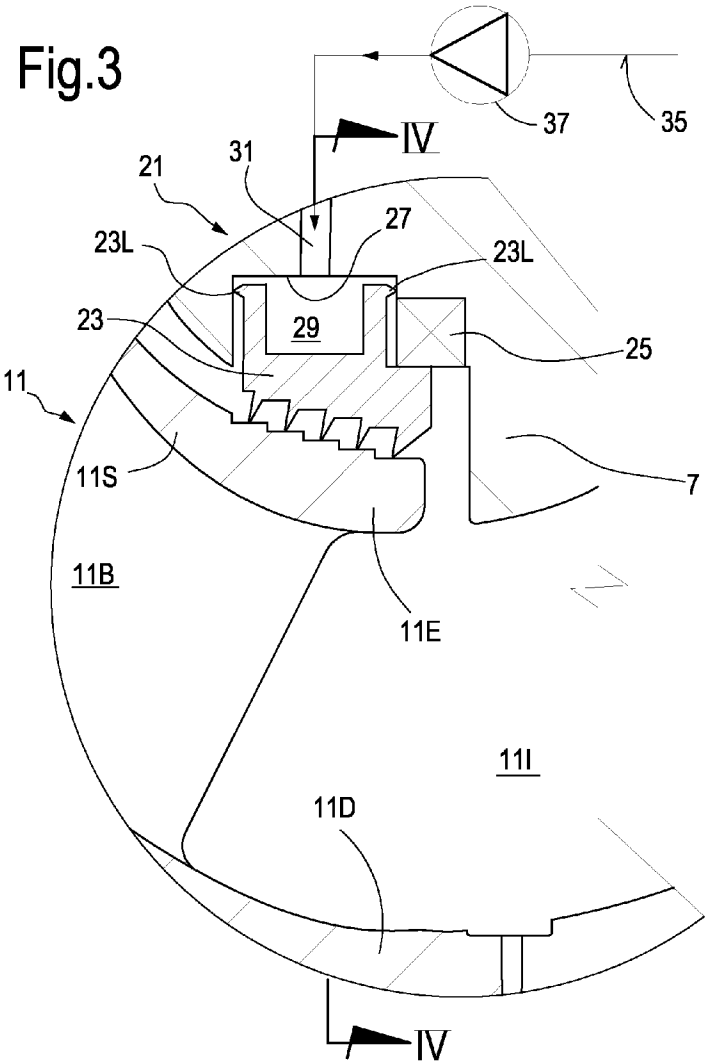
FIG. 3 illustrates an enlargement of the sealing arrangement at the impeller eye of one of the stages of the compressor of FIG. 1.

Between the stationary diaphragm 7 and the impeller eye 11E a sealing arrangement 21 is provided. FIG. 3 illustrates an enlargement of an embodiment of the sealing arrangement of one of the impellers 11 of compressor 1. FIG. 4 illustrates a schematic cross-section of the stationary component (diaphragm) 7, of the impeller eye 11E and of the sealing arrangement 21.

The sealing arrangement 21 can comprise an annular sealing member 23. In some embodiments the annular sealing member 23 is mounted on the diaphragm 7 with the aid of a plurality of angularly spaced keys 25, which can maintain the annular sealing member 23 centered with respect to the diaphragm 7. The sealing arrangement 21 is mounted on the stationary component, i.e. on the diaphragm 7, such that the sealing arrangement and the stationary component can radially move one with respect to the other. In this way, differential thermal expansions of the annular sealing member 23 and the stationary component 7 are possible.

In some embodiments the diaphragm 7 is comprised of a seat 27 wherein the annular sealing member 23 is at least partly housed. A cooling chamber or cooling channel 29 is formed between the annular sealing member 23 and the seat 27 provided in the diaphragm 7. Sealing lips 23L can be provided around the annular sealing member 23 for sealing against the seat 27 of the diaphragm 7. The cooling chamber 29 is thus sealed against the volume where the impeller 11 is rotatably housed.

The cooling chamber 29 is in fluid communication with a source of cooling fluid. In some embodiments the cooling chamber is arranged as a part of a cooling fluid circuit, so that cooling fluid is delivered in and through the cooling chamber and removed therefrom. As best shown in the schematic cross section of FIG. 4, in some embodiments at least one cooling fluid-delivered duct 31 is in fluid communication with the cooling chamber 29 and delivers a cooling fluid therein. At least one cooling fluid-discharge duct 33 can also be provided, in fluid communication with the cooling chamber 29, for removing the cooling fluid once the latter has circulated through the cooling chamber 29.

In FIG. 4 the cooling chamber 29 and the annular sealing member 23 are co-extensive, i.e. they extend along 360° around the impeller axis. The cooling chamber 29 is thus in fluid contact with the sealing arrangement along the entire annular extension thereof. This may be a configuration. However, in other embodiments, the extension of the cooling chamber 29 can be slightly less than the annular extension of the sealing arrangement, e.g. the cooling chamber 29 can be divided into two or more sub-chambers, separated by e.g. radial partitions, so that the total extension of the cooling chamber 29 might be slightly less, e.g. 10% less than the annular extension of the sealing arrangement.

The arrangement disclosed here above allows a controlled circulation of a cooling fluid into and through the cooling chamber or cooling channel 29 of each impeller 11, for which such arrangement is provided.

The cooling fluid can be provided by a cooling fluid circuit schematically shown at 35 in FIG. 3. The cooling fluid circuit can comprise a fan 37, a pump or any other circulation device.

The cooling fluid can be any fluid suitable for removing heat from the sealing arrangement 21. In some embodiments an incompressible, liquid cooling fluid can be used, for example diathermic oil. This cooling fluid is particularly efficient in removing heat by forced convection through the cooling chamber or cooling channel 29.

In some embodiments a gaseous cooling fluid can be used. In particular embodiments, a cooling fluid is used, which is compatible with the gas being processed by the compressor 1. In this way, any leakage of cooling fluid from the cooling chamber 29 will not adversely affect the processing of the gas through the compressor 1.

Typically in CAES or ACAES applications, where the compressor 1 processes air, environment air can be used as cooling medium or cooling fluid in the cooling chamber 29.

The cooling fluid circuit 35 can be open towards the environment, so that the cooling fluid exiting the cooling chamber 29 is discharged in the environment, if the nature of the cooling fluid and other considerations so permit, for example if air is used as cooling fluid.

In other embodiments, the cooling fluid circuit 35 can be closed and the cooling fluid can be circulated therein, heat exchanging arrangements being possibly provided for removing heat from the cooling fluid flow, once the latter exits the cooling chamber 29.

In some embodiments, the pressure of the cooling fluid in the cooling chamber 29 is substantially less than the pressure of the gas being processed through the compressor 1. Since the cooling chamber 29 can be sealed against the impeller 11, leakage between the impeller and the cooling chamber 29 can be prevented and a low pressure can be established inside the cooling chamber 29. This reduces the power required for circulating the cooling fluid through the circuit 35 and the cooling chamber 29.

Circulating cooling fluid through the cooling chamber 29 and removing heat from the sealing arrangement 21 allows a control over the radial dimension and radial growth of the sealing arrangement 21 during start-up and steady state operation of the turbomachine, in order to obtain a better control over the radial clearance between the sealing arrangement 21 and the impeller eye 11E as will be discussed in greater detail here below.

In current art arrangements, where the sealing member 21 is constrained to the diaphragm 7, the radial dimension of the annular sealing member must be selected so as to provide sufficient clearance at start-up and sufficiently small clearance at steady state condition, bearing in mind that the radial growth of the impeller 11 at start-up is faster than the radial growth of the diaphragm 7, due to the higher thermal inertia of the diaphragm 7 with respect to the impeller 11.

In following Table 1 the dimension of the radial clearance in a current art machine at start-up and during steady state operation is given in millimeters, reference being made to an exemplary, non-limiting embodiment:

TABLE 1

| | Start Up | Steady State |
|---|---|---|
| Assembly Radial Clearance[mm] = A | 0.95 | 0.95 |
| Rotor Radial Growth (Centrifugal and Thermal) [mm] = B | 0.70 | 0.85 |
| Stator Radial Growth (Thermal) [mm] = C | 0.25 | 0.75 |
| Total Radial Clearance [mm] = A − B + C | 0.50 | 0.85 |

The sealing arrangement is designed and dimensioned so that, when the machine is non-operating and at room temperature, a radial clearance of 0.95 mm will exist between the sealing member and the rotary member, e.g. the impeller eye.

At start-up, the impeller eye 11E is subject to a radial growth due on the one hand to the mechanical deformation caused by centrifugal force applied to the impeller eye 11E. On the other hand, the impeller eye 11E expands due to fast temperature increase. Thermal expansion is particularly significant in the last stages of a centrifugal compressor 11 as shown in FIG. 1, where the processed gas, for example air, reaches high temperature values, for example around 400-600° C.

During start-up the radial growth of the stationary component represented by the diaphragm 7 is much slower than the radial growth of the impeller 11, on the one side because no centrifugal forces deform radially outwardly the stationary component, and on the other side because the thermal inertia of the diaphragm 7 is such that thermal expansion is slower for the diaphragm 7 than for the impeller 11.

Consequently, radial expansion of the stator or stationary component 7 is around 0.25 mm, while the radial expansion of the impeller eye 11E is 0.70 mm.

Since the annular sealing member 23 is radially constrained to the diaphragm, the radial expansion of the annular sealing member is the same as the radial expansion of the diaphragm. Consequently, starting with a radial clearance of 0.95 mm in standstill conditions at room temperature, the total clearance at start-up is 0.50 mm.

As the compressor slowly reaches the steady state operating condition, the temperature of the diaphragm increases and consequently the radial dimension of the annular sealing member also increases. In the second column of Table 1 the radial expansion of the impeller eye 11E at steady state conditions is indicated as 0.25 mm, while the radial expansion of the diaphragm is 0.75 mm. The total radial clearance at steady state condition is therefore 0.85 mm. This relatively large radial clearance causes decay in the efficiency of the machine. A smaller radial clearance at steady state conditions is not suitable, since it would require a smaller clearance at start-up and consequent risk of rubbing contact between the impeller eye and the annular sealing member during start-up, due to the slower radial expansion of the diaphragm and the annular sealing member with respect to the radial expansion of the impeller.

The sealing member cooling and temperature control arrangement of the present disclosure solves or at least alleviates the above problem, resulting in smaller radial clearance at steady state conditions, as shown in Table 2:

TABLE 2

| | Start Up | Steady State |
|---|---|---|
| Assembly Radial Clearance[mm] = A | 0.95 | 0.95 |
| Rotor Radial Growth (Centrifugal and Thermal) [mm] = B | 0.70 | 0.85 |
| Stator Radial Growth (Thermal) [mm] = C | 0.25 | 0.00 |
| Total Radial Clearance [mm] = A − B + C | 0.50 | 0.10 |

Table 2 illustrates the dimension of the radial clearance between the impeller eye 11E and the annular sealing member 23 in a configuration according to the present disclosure and in an exemplary embodiment. The clearance dimension is expressed in mm. When the compressor is at still stand and at room temperature, the radial clearance between the annular sealing member 23 and the impeller eye 11E is again 0.95 mm. The radial expansion of the impeller eye 11E at start-up is again 0.70 mm and is due to the mechanical radial deformation caused by the centrifugal forces and to thermal expansion. The radial expansion of the diaphragm 7 is again 0.25 mm, this resulting in a total radial clearance of 0.50 mm at start-up. The same conditions as in the current art compressor (Table 1) are given, where no clearance control and sealing temperature control is provided.

Upon reaching of the steady-state operating conditions, however, the cooling fluid flowing through the cooling chamber 29 can remove heat from the sealing arrangement 21, thus reducing the radial expansion due to thermal expansion of the annular sealing member 23. In the example shown in Table 2, it is assumed that cooling of the sealing arrangement 21 is sufficiently efficient to reduce the radial expansion of the annular sealing member 23 to zero. Consequently, the total radial clearance between the annular sealing member 23 and the impeller eye 11E becomes 0.10 mm, which is less than the total radial clearance (0.85 mm) of the compressors according to the current art (Table 1) under the same steady state operating conditions. The reduced total radial clearance at steady state conditions increases substantially the overall efficiency of the compressor 1.

The effect of temperature control over the sealing arrangement discussed here above in connection with the sealing arrangement of the impeller eye can be exploited also in other parts of the compressor 1, for example to reduce the clearance between the balancing drum 13 and the sealing there around. In the enlargement of FIG. 2, a sealing arrangement 41 acting on the balancing rotor 13 is illustrated. The sealing arrangement 41 can be comprised of an annular sealing member 43. The annular sealing member 43 can be mounted on the stationary component which, in this case, is shown at 17A and is part of the volute 17. A cooling chamber 45 can be provided between the annular sealing member 43 and the stationary component 17A.

The cooling chamber 45 can be formed, for example, between an annular groove 43G formed in the annular sealing member 43 and an annular expansion 17E provided on the stationary component 17A. Seals 47 can be provided around the groove 43G to seal the cooling chamber or channel 45.

In other embodiments, a seat for the annular sealing member 43, similar to seat 27, can be provided in the stationary component 17A.

In some embodiments a cooling fluid delivery duct 49 delivers a cooling fluid from a cooling fluid source, for example the fan 37 shown in FIG. 3, into and through the cooling chamber 45. A cooling fluid discharge duct, not shown, similar to the duct 33, can be provided for removing the cooling fluid from the cooling chamber 45.

The cooling chamber 45 and relevant cooling fluid delivery arrangement provide for a temperature control of the annular sealing member 43 in quite the same manner as disclosed above in connection with the sealing arrangement 21 of the impeller eye.

Cooling of the annular sealing member 43 provides control over the clearance between the balancing drum 13 and the stationary component 17A, further contributing to the efficiency improvement of the compressor 1.

Figure 5:
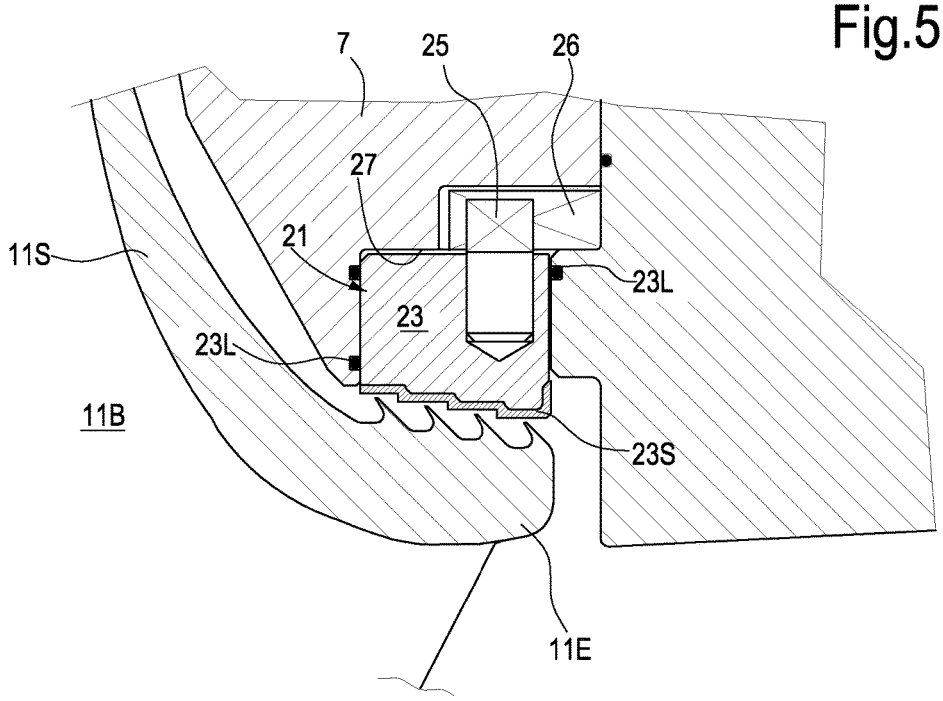
FIG. 5 illustrates a cross-section of a sealing arrangement for an impeller eye according to a further embodiment, showing a cooling fluid circulation chamber arranged inside the sealing arrangement.
Figure 6:
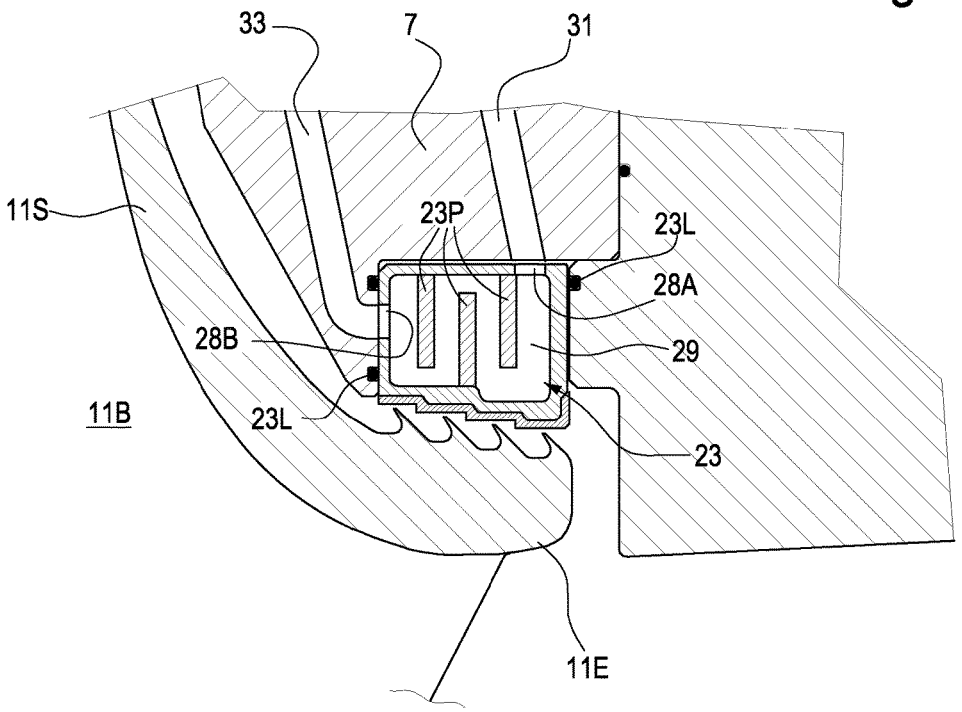
FIG. 6 illustrates a further cross-section of a sealing arrangement with a key torsionally locking the sealing ring with respect to the stationary component of the turbomachine.

FIGS. 5 and 6 illustrate a further embodiment of a sealing arrangement of the impeller eye 11E of a compressor impeller 11. The same reference numbers designate the same or equivalent parts as shown in FIG. 3.

Between the stationary diaphragm 7 of the compressor and the impeller eye 11E a sealing arrangement 21 is provided. In the illustrated embodiment, the sealing arrangement 21 comprises an annular sealing member 23. In some embodiments the annular sealing member 23 is mounted on the diaphragm 7 with the aid of a plurality of angularly spaced keys 25, which can maintain the annular sealing member 23 centered with respect to the diaphragm 7. FIG. 5 illustrates a section according to a radial plane showing a key 25 which engages into a notch 26 of the stationary component 7 providing centering and torsional coupling between the sealing arrangement 21 and the stationary component or diaphragm 7.

In some embodiments the diaphragm 7 is comprised of a seat 27 wherein the annular sealing member 23 is at least partly housed. A cooling chamber or cooling channel 29 is formed between a sealing surface 23S of the annular sealing member 23 and the seat 27. In the embodiment shown in FIGS. 5 and 6 the cooling chamber is formed inside the annular sealing member 23 (see in particular FIG. 6).

Sealing gaskets 23L are provided around the annular sealing member 23, acting against opposing surfaces of the diaphragm 7. In the embodiment illustrated in FIGS. 5 and 6 the sealing gaskets are arranged in annular grooves provided in the seat of the diaphragm 7. In other embodiments the sealing gaskets or other sealing means can be arranged in annular grooves provided in the side surfaces of the annular sealing member 23. The cooling chamber 29 is sealed by the sealing gaskets 23L against the volume where the impeller 11 is rotatably housed.

As described in connection with FIG. 3, the cooling chamber 29 is in fluid communication with a source of cooling fluid. In some embodiments the cooling chamber is arranged as a part of a cooling fluid circuit, so that cooling fluid is delivered in and through the cooling chamber and removed therefrom. In some embodiments at least one cooling fluid-delivered duct 31 is in fluid communication with the cooling chamber 29 and delivers a cooling fluid therein. A cooling fluid-discharge duct 33 can also be provided, in fluid communication with the cooling chamber 29, for removing the cooling fluid once the latter has circulated through the cooling chamber 29.

In the embodiment shown in FIGS. 5 and 6, the annular sealing member 23 has a substantially tubular, i.e. hollow structure, with a hollow cross-section (FIG. 6). One wall of the hollow structure can be provided with one or more cooling-fluid inlet and outlet ports 28A and 28B, in fluid communication with one or more cooling-fluid delivery duct(s) 31 and one or more cooling-fluid discharge duct(s) 33. For a more efficient circulation of the cooling fluid in the cooling chamber 29 formed in the interior of the hollow annular sealing member 23, partition walls 23P can be provided in the empty cavity of the annular sealing member 23. The partition walls 23P can extend annularly inside the cooling chamber 29 and project from opposing cylindrical walls of the annular sealing member 23, so as to form a sort of labyrinth arrangement, for improved cooling-fluid circulation and enhanced heat removal.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. Different features, structures and instrumentalities of the various embodiments can be differently combined.

What is claimed is:

1. A turbomachine, comprising:

a stationary component;

a rotary component, rotatingly supported in the stationary component;

an annular seal disposed between the rotary component and the stationary component, the annular seal having a sealing surface facing the rotary component; and a cooling chamber arranged in thermal communication with the annular seal, the cooling chamber having a wall disposed between the cooling chamber and the sealing surface of the annular seal, the cooling chamber arranged to circulate a cooling fluid through the cooling chamber to remove heat from the annular seal to vary the thermal expansion of the annular seal.

2. The turbomachine of claim 1, wherein the annular seal comprises at least a portion of the cooling chamber.

3. The turbomachine of claim 2, wherein the stationary component further comprises at least one cooling fluid-delivery duct, which is fluidly connected with the cooling chamber, for delivering cooling fluid therein.

4. The turbomachine of claim 3, wherein the stationary component further comprises at least one cooling fluid-discharge duct in fluid communication with the cooling chamber, for removing cooling fluid therefrom.

5. The turbomachine of claim 2, wherein the stationary component includes a seat to mount the annular seal thereto.

6. The turbomachine of claim 5, wherein the annular seal and the seat are capable of mutual radial displacements.

7. The turbomachine of claim 5, wherein the cooling chamber is arranged annularly between the annular seal and the seat such that the annular seal and the stationary component form the cooling chamber.

8. The turbomachine of claim 5, wherein the cooling chamber is formed in the annular seal.

9. The turbomachine of claim 8, wherein the annular seal is hollow to form the cooling chamber.

10. The turbomachine of claim 9, wherein the cooling chamber is substantially tubular.

11. The turbomachine of claim 9, wherein the cooling chamber further includes partition walls therein to form a labyrinth.

12. The turbomachine of claim 11, wherein the cooling chamber includes at least one cooling-fluid inlet and at least one cooling-fluid outlet.

13. The turbomachine of claim 12, wherein the stationary component further comprises:

at least one cooling fluid-delivery duct in fluid communication with the at least one cooling-fluid inlet of the cooling chamber; and at least one cooling fluid-discharge duct in fluid communication with the cooling chamber, for removing cooling fluid therefrom.

14. The turbomachine of claim 5, wherein sealing gaskets are located between the annular seal and the seat of the stationary component.

15. The turbomachine of claim 1, wherein the rotary component comprises an impeller.

16. The turbomachine of claim 15, wherein the impeller comprises an impeller disc, an impeller shroud, an impeller eye and a plurality of blades arranged between the impeller disc and the impeller shroud, forming a plurality of impeller vanes; and wherein the annular seal is located around the impeller eye for sealing the impeller eye against the stationary component.

17. The turbomachine of claim 15, wherein the rotary component comprises a balancing drum and wherein the annular seal is located around the balancing drum for sealing the balancing drum against the stationary component.

18. A method for controlling a seal clearance in a turbomachine between a rotary component of the turbomachine and an annular seal co-acting with the rotary component, the method comprising:

circulating selectively a cooling fluid through a cooling chamber in thermal communication with the annular seal to remove heat from the annular seal for controlling thermal expansion of the annular seal during operation of the turbomachine.

19. The method of claim 18, further includes:

delivering a cooling fluid in the cooling chamber through at least one cooling fluid-delivery duct; and removing the cooling fluid from the cooling chamber through at least one cooling fluid-discharge duct.

20. The method of claim 18, further comprising sealing the cooling chamber against a volume where the rotary component is housed.

* * * * *